US008783415B2

(12) United States Patent
Bancroft

(10) Patent No.: US 8,783,415 B2
(45) Date of Patent: Jul. 22, 2014

(54) LADDER SUPPORT DEVICE

(76) Inventor: Russell N. Bancroft, Simi Valley, CA (US)

( * ) Notice: Subject to any disclaimer, the term of this patent is extended or adjusted under 35 U.S.C. 154(b) by 55 days.

(21) Appl. No.: 13/507,722

(22) Filed: Jul. 24, 2012

(65) Prior Publication Data

US 2014/0027202 A1 Jan. 30, 2014

(51) Int. Cl.
*E06C 7/10* (2006.01)

(52) U.S. Cl.
USPC ..... 182/107; 182/45

(58) Field of Classification Search
CPC ..... E06C 7/48; E06C 7/488; E04G 3/26
USPC ..... 182/107, 45
See application file for complete search history.

(56) References Cited

U.S. PATENT DOCUMENTS

| | | | | |
|---|---|---|---|---|
| 6,152,262 | A | 11/2000 | Jung | |
| 6,408,983 | B1 | 6/2002 | Widurski | |
| 6,490,842 | B2 | 12/2002 | Emmons | |
| 6,578,665 | B1 | 6/2003 | DeBaca | |
| 6,722,469 | B1 * | 4/2004 | Weger, Jr. | 182/107 |
| 6,837,338 | B2 | 1/2005 | Grover | |
| 7,293,630 | B1 | 11/2007 | Trebec | |
| 7,753,170 | B1 | 7/2010 | Gibson | |
| 7,757,814 | B2 | 7/2010 | Pleadwell | |
| 8,104,575 | B1 | 1/2012 | Bancroft | |
| 2002/0046543 | A1 * | 4/2002 | Neuleib | 52/749.12 |
| 2003/0037990 | A1 * | 2/2003 | Testa, Jr. | 182/45 |
| 2003/0188924 | A1 | 10/2003 | Bamber | |
| 2007/0267251 | A1 | 11/2007 | Poldmaa | |
| 2011/0127110 | A1 | 6/2011 | Trang | |

FOREIGN PATENT DOCUMENTS

EP 859104 A1 * 8/1998

* cited by examiner

*Primary Examiner* — Alvin Chin-Shue
(74) *Attorney, Agent, or Firm* — Beaumont Gitlin Tashjian; Larry F. Gitlin

(57) ABSTRACT

A safety device for a ladder and one or more support platforms disposed upon an underlying roof surface comprising a panel member having a top side, a bottom side, a back edge portion, a first side edge portion, a second side edge portion, and a front U-shaped edge portion with laterally spaced-apart forwardly extending arms for positioning a ladder there between to contain the ladder and prevent its lateral movement beyond the arms. The panel member and the support platform each has the means in cooperating relation to attach the panel member to the support platform in releasable engagement to enable the panel member and the support platform to easily disconnect and reconnect to further enable the adjustment of the positioning of the panel member relative to one or more adjacently or closely placed support platforms situated along or near the edge of said roof surface.

17 Claims, 14 Drawing Sheets

LADDER SUPPORT DEVICE

FIELD OF THE INVENTION

The present invention relates generally to the construction trade and, more particularly, to an improved device that provides and ensures stability and safety in the use of a ladder utilized by a construction worker to access, ascend and descend from, sloped and elevated flat roof surfaces built to protect and cover residential and commercial structures.

BACKGROUND OF THE INVENTION

In the construction and related trades, particularly the construction and maintenance of roofs and similarly sloped surfaces, these situations call for the most stable and safe working conditions due to the inherently unsafe circumstances of the nature of the work. All too often, workers climbing ladders to reach a roof surface or walk on a roof for purposes of maintaining or repairing or even installing an entirely new roof, engage in activities that risk serious personal injury or possibly even death. Falling from the height of a typical residential or commercial roof or from the upper rungs of an unstable ladder is rarely a forgiving event.

Support pad or platform devices comprising a wide variety of configurations and structural components for use in working and walking under relatively stable conditions upon sloped surfaces, especially roofs, include, but are not limited to, the devices disclosed in the following:

U.S. Pat. No. 6,490,842 B2 issued to Emmons is directed to a traction pad for use in roof-related repairs of a sloped roof. The device includes a traction pad for maneuvering on a roof and contains a base layer, traction layer, at least two traction cross members and two end members. The base and traction layers are preferably rectangular in shape. The bottom side of the base layer contacts the roof with the traction layer attached to the top side, with at least two traction cross-members attached to the top side across its length. The two end members are attached adjacent the ends of the two traction cross members. A pair of lifting handles are also provided. The top side of the traction layer is typically covered with a paint containing dissolved sand to provide improved traction.

U.S. Pat. No. 8,104,575 B1 issued to Bancroft is directed to a support pad apparatus that includes a rigid platform and a load spreading conformable pad beneath that conforms to the bottom surface of the platform and may either be flat or concave along the bottom surface to engage the surface of a flat, uneven or even sloped roof. The top surface of the platform contains tapered slots along its horizontal axis, which can be used to stabilize the worker's footing. If the slots are closed with a slidable insert, the apparatus provides the person standing and working on the platform with a more stable and secure footing under a variety of different circumstances.

U.S. App. Publication No. 2003/0037990 A1 (inventor Testa) is directed to a pad providing protection, safety and stabilization to a worker on a sloped surface, which has the added benefit of protecting the sloped surface itself, such as a shingled or any other kind of roof. The pad is primarily flexible to effectively grip or attach itself to a sloped surface, and contains a multitude of indentations or footholds on the upper surface for engagement of the worker's shoes to provide stability.

The other component essential to securing a stable ladder from the ground surface to the roof and to ensure the integrity of the ladder in the process, is a device heretofore unknown in the prior art. This device maintains a constant alignment between the base of the ladder and the upper rungs that meet and lean against the edge of the roof, where the worker transitions from the ladder to the roof surface. To ensure the stability and integrity of this device on the roof or near the roof's edge, the device is typically attached to a support pad or platform such as any of those previously mentioned in this application.

A variety of so-called ladder stability devices are known in the prior art and include, but are not limited to, the following:

U.S. Pat. No. 6,837,338 B2 issued to Grover is directed to a ladder safety device for securing a ladder to a building or roof to prevent the ladder from sliding or coming loose. The device stabilizes the upper portion of the ladder, preventing the ladder from dislocating, and generally consists of a pair of brace plates, where each plate is positioned on opposing sides of each ladder rail. A pair of clamps are mounted onto the brace plates and then secured to the building. The brace plates are clamped on either side of the ladder using a through-rod inserted through one of the hollow ladder rungs.

U.S. Pat. No. 6,408,983 B1 issued to Widurski is directed to a ladder stabilizing device provided for removable securement to the upper ends of the spaced-apart stiles of a ladder in order to position the ladder a predetermined distance from the vertical wall surface of a building structure to allow the ladder to lean against an inside and outside corner of the structure. The structure includes a pair of ladder stabilizing support members with each supporting sport member including an elongating main body portion for spacing the ladder from the vertical wall surface.

U.S. Pat. No. 6,152,262 issued to Jung is directed to a ladder stabilizing device to prevent top-skidding of a ladder and provide top ladder stabilizing. The safety device includes a plurality of side safety supports that are stored in one of the ladder rungs located at the upper portion of the ladder. The side safety supports are extendable from one rung to a stabilizing extended position in which the side safety stabilizers are in contact with the vertical supporting surface when the ladder is placed against the wall supporting surface, such as a wall.

U.S. App. Publication No. 2003/0188924 A1 (inventor Bamber) is directed to a safety device for ladders that are capable of temporarily holding the top portion of a ladder securely to a building or other structure. In one embodiment of the invention, the safety device comprises an arm attached to an upper portion of a ladder and a holding mechanism. The arm has two end portions comprising a first end portion for attachment to an upper portion of a ladder and a second end portion for holding the ladder to a structure. The holding mechanism may be joined to the second end portion of the arm.

U.S. App. Publication No. 2007/0267251 A1 (inventor Poldmaa) is directed to a safety device for a ladder in the form of a support bracket attached to a ladder for securement to the roof of a house to prevent the ladder from dislodging. A bracket arrangement for removable attachment to the upper regions of the ladder is utilized for this purpose and includes a pair of laterally spaced-apart arms for adjustably rotatable attachment to the ladder. The arms extend generally away from the ladder towards a roof of a building when the ladder is used against the side of the building to gain access to the roof. The angle between the arms and the plane of the ladder is adjustable to suit varying conditions of use. The bracket has a cross-member extending between the free ends of each arm for placement against the roof of the building.

U.S. App. Publication No. 2011/0127110 A1 (inventor Trang) is directed to a safety device for straight and extension ladders for stabilizing and holding the ladders in place to ensure the user's safety while climbing and/or performing work while on the ladder. The safety device includes an upper stabilizer assembly that makes the ladder adaptable to any shaped structure or surface, a lower stabilizer assembly that makes the ladder adjustable to accommodate for uneven ground, a leveling measurement device that allows the user to quickly and easily determine if the ladder is level and angled correctly, and a storage tray that provides a storage area for tools and other items.

U.S. Pat. No. 6,578,665 B1 issued to DeBaca is directed to a ladder stabilizing device for attachment to a structure, such as a building, for stabilizing the upper end portion of a ladder and preventing damage to structure fascia when the ladder is leaned against the structure for support. Two stops prevent the ladder from excessive lateral movement. A support bar affixed to and extending between the stops provides support for the ladder. A mounting bracket on each stop is attached either directly to a structure surface, or to a U-shaped bracket that fits around a rain gutter. Each U-shaped bracket fits over or under the rain gutter and is attached to the structure's surface. In an alternative embodiment of the invention, two support legs bent at obtuse angles in two locations comprise an attachment portion for attaching to the roof of a structure, a ramp portion for extending beyond the roof eave and a stop portion for preventing excessive lateral movement of the ladder. A support bar is affixed to and extends between the stop portions for supporting the ladder.

U.S. Pat. No. 7,757,814 B2 issued to Pleadwell is directed to a ladder stabilizer for ladders with tubular rungs, which include a rigid stabilizer bar having a top, a bottom, a first end and a second end. A first leg extends downwardly below the bottom of the stabilizer bar at the first end and a second leg extends downwardly below the bottom of the stabilizer bar at the second end. A rung attachment bar is provided which is adapted to extend through a tubular rung of a ladder. The rung attachment bar has a first end and a second end. Means are provided to secure the rung attachment in parallel relation to the stabilizer bar.

U.S. Pat. No. 7,753,170 B1 issued to Gibson is directed to a ladder top made for holding tools as well as for resting against a variety of shaped surfaces, including a flat support surface, the corner of a building, a square pole, a round pole, and trees. The invention also relates to ladders that are adapted for use against and supported by such surfaces. The device comprises a cover for a ladder top that includes a top panel, a front side extending downwardly from one side of a top panel and indentation formed therein, and a belt connected to the top panel for maintaining the front side of a top panel in juxtaposition against an extrinsic surface. The indentation is generally v-shaped. A first slot is formed on one side of the indentation band a second slot is formed on the other side of the indentation. The belt extends through both the first and second slots to secure the ladder.

U.S. Pat. No. 7,293,630 B1 issued to Trebec is directed to a device that provides existing ladders with increased lateral stability to prevent falls and increase safety. This device is useful with conventional ladders, including folding and/or extension ladders. In the preferred embodiment of the device, a stabilization device is provided that includes an upper shaft for operative coupling to an upper end of a ladder. An elongated outer leg has upper and lower ends, and its upper end has an aperture for receiving the upper shaft in a generally horizontal position. An elongate inner leg is positioned in the outer leg and configured for telescoping extension relative to the outer leg, and means are included for maintaining the inner leg at a plurality of predetermined positions relative to the outer leg. A foot is coupled to the lower end of the inner leg for placement on a ground surface.

In all of the aforementioned patents and published applications, the devices that are disclosed are unnecessarily complicated, include an overabundance of extraneous components that likely require detailed instructions to assemble correctly or require a significant time consuming effort to install or attach properly to the roof or wall of the structure to ensure its integrity.

However, until the conception and reduction to practice of the present invention, there has never existed any device in the prior art that includes the unique structural and functional elements associated specifically with the present invention, namely the most effective, safe and reliable means for a roof worker to climb or descend a conventional ladder (fixed or extension) to transition onto and off of sloped and elevated flat roof surfaces.

SUMMARY OF THE INVENTION

The present invention combines a safety device and one or more support platforms disposed upon an underlying roof surface comprising more particularly a panel member having a top side, a bottom side, a back edge portion, a first side edge portion, a second side edge portion, and a front generally U-shaped edge portion with laterally spaced apart forwardly extending arms for positioning a fixed or extension ladder there between for containing lateral movement of the ladder beyond the arms. The panel member and the support platform each has the means in cooperating relation to connect and secure the two components in releasable engagement to enable the panel member and the support platform to easily disconnect and reconnect to further enable the adjustment of the positioning of the panel member relative to one or more adjacently placed support platforms situated along or near the edge of the roof surface.

Accordingly, it is an object of the present invention to provide an improved device that provides and ensures stability and safety in the use of a ladder employed to give a construction worker the ability to access and ascend and descend from sloped and elevated flat roof surfaces of a residential or commercial building.

Another object of the present invention is to provide an improved device that ensures stability and safety in the use of a ladder employed to give a construction worker the ability to access and ascend and descend from sloped and elevated flat roof surfaces having a front U-shaped edge portion with laterally spaced apart forwardly extending arms for securing the ladder and containing its lateral movement.

Another object of the present invention is to provide an improved device that ensures stability and safety in the use of a ladder employed to give a construction worker the ability to access and ascend and descend from sloped and elevated flat roof surfaces that utilizes cooperating components that easily connects to and disconnects from each other.

Another object of the present invention is to provide an improved device that ensures stability and safety in the use of a ladder employed to give a construction worker the ability to access and ascend and descend from sloped and elevated flat roof surfaces that utilizes cooperating components adapted for releasable engagement to enable the panel member to easily disconnect from and then reconnect to the support platform to adjust the position of the panel relative to one or more adjacently placed support platforms situated along or near the edge of the roof surface.

Another object of the present invention is to provide an improved device that ensures stability and safety in the use of a ladder employed to give a construction worker the ability to access and ascend and descend from sloped and elevated flat roof surfaces wherein the panel member and support platform are adapted to be attached and adjustable relative to each other to enable the panel member to extend incrementally forward or incrementally rearward of either the first or second side edge of the support platform to enable adjustable positioning relative to the ladder.

Another object of the present invention is to provide an improved device that ensures stability and safety in the use of a ladder employed to give a construction worker the ability to access and ascend and descend from sloped and elevated flat roof surfaces that is easy and cost effective to manufacture Other objects and advantages of the present invention will become apparent in the following specifications when considered in light of the attached drawings wherein the preferred embodiment of the invention is illustrated.

The features of this invention, which are believed to be novel, are set forth with particularity in the appended claims. The present invention, both as its organization and manner of operation, together with further objects and advantages thereof, may be best understood by reference to the following detailed description, taken in conjunction with the accompanying drawings.

DETAILED DESCRIPTION OF THE PREFERRED AND ALTERNATIVE EMBODIMENT

Figure 1:
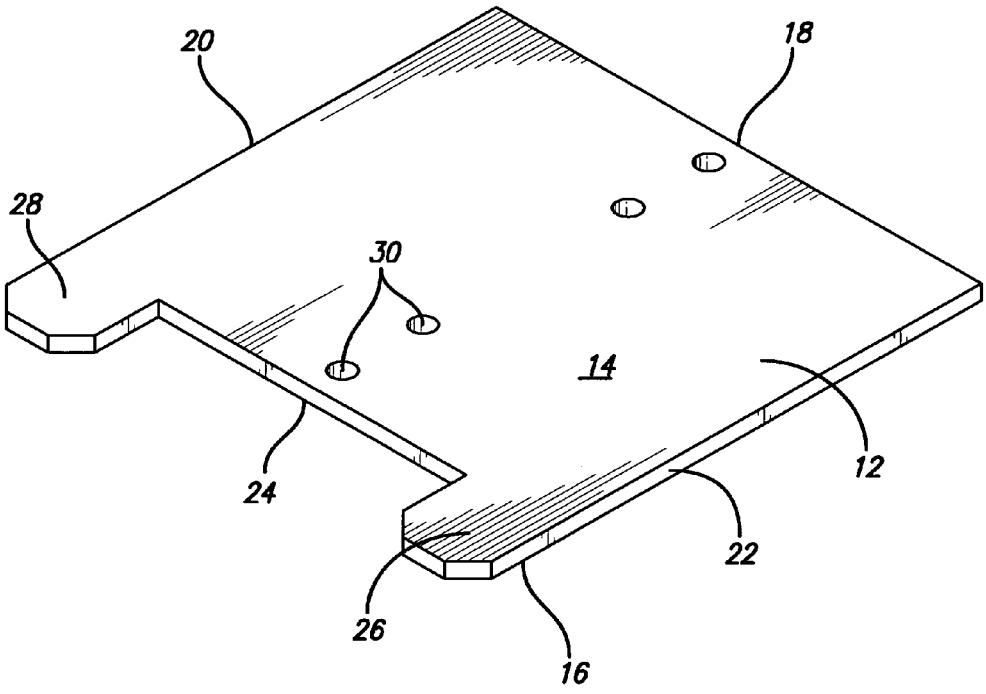
FIG. 1 is a perspective view of one embodiment of the panel member in accordance with the present invention.
Figure 2:
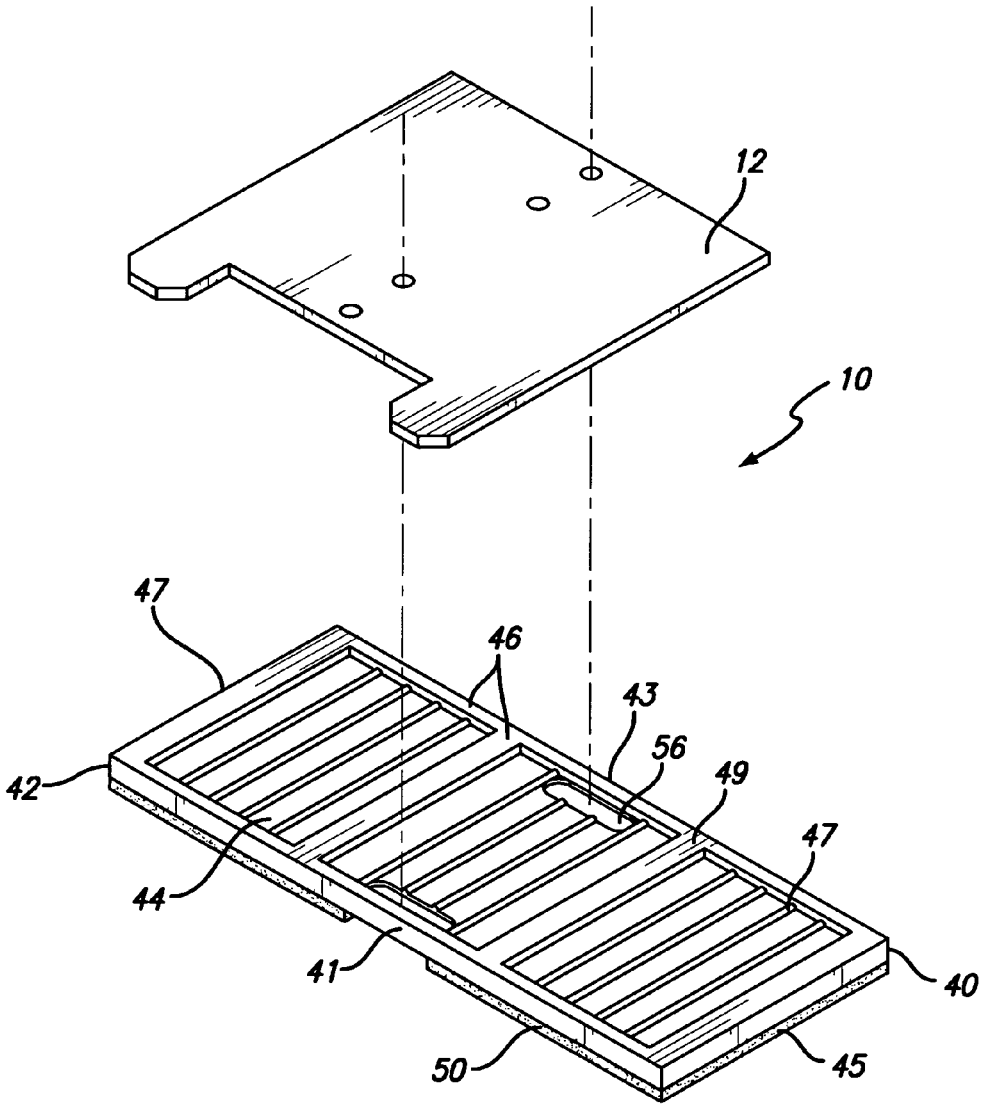
FIG. 2 is a perspective view of the panel member just prior to attachment to the support platform in accordance with the present invention.
Figure 3:
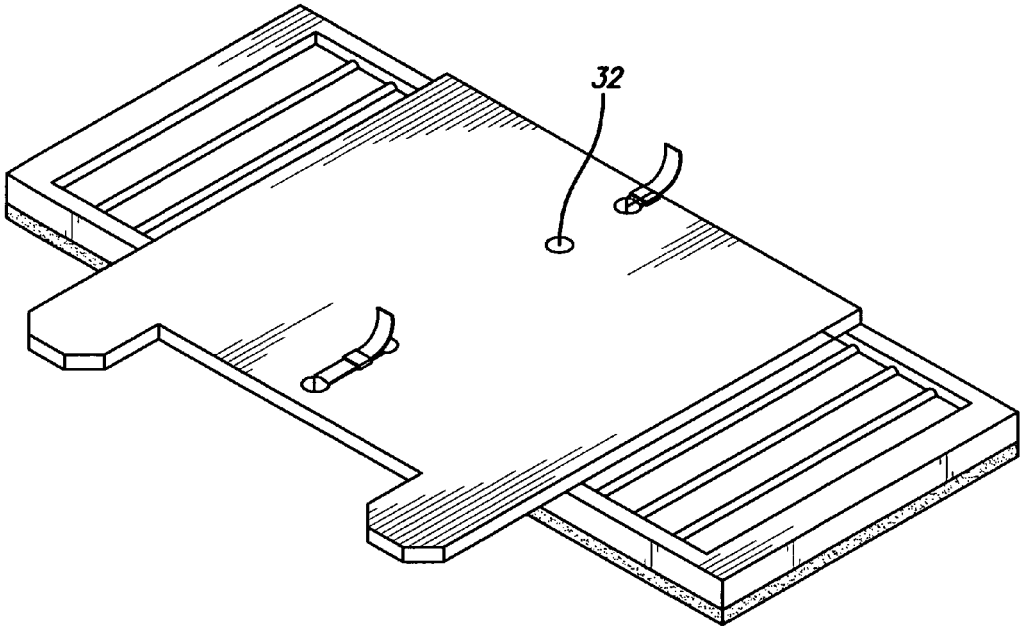
FIG. 3 is a perspective view of one embodiment of the panel member attached to the support platform in accordance with the present invention.
Figure 4:
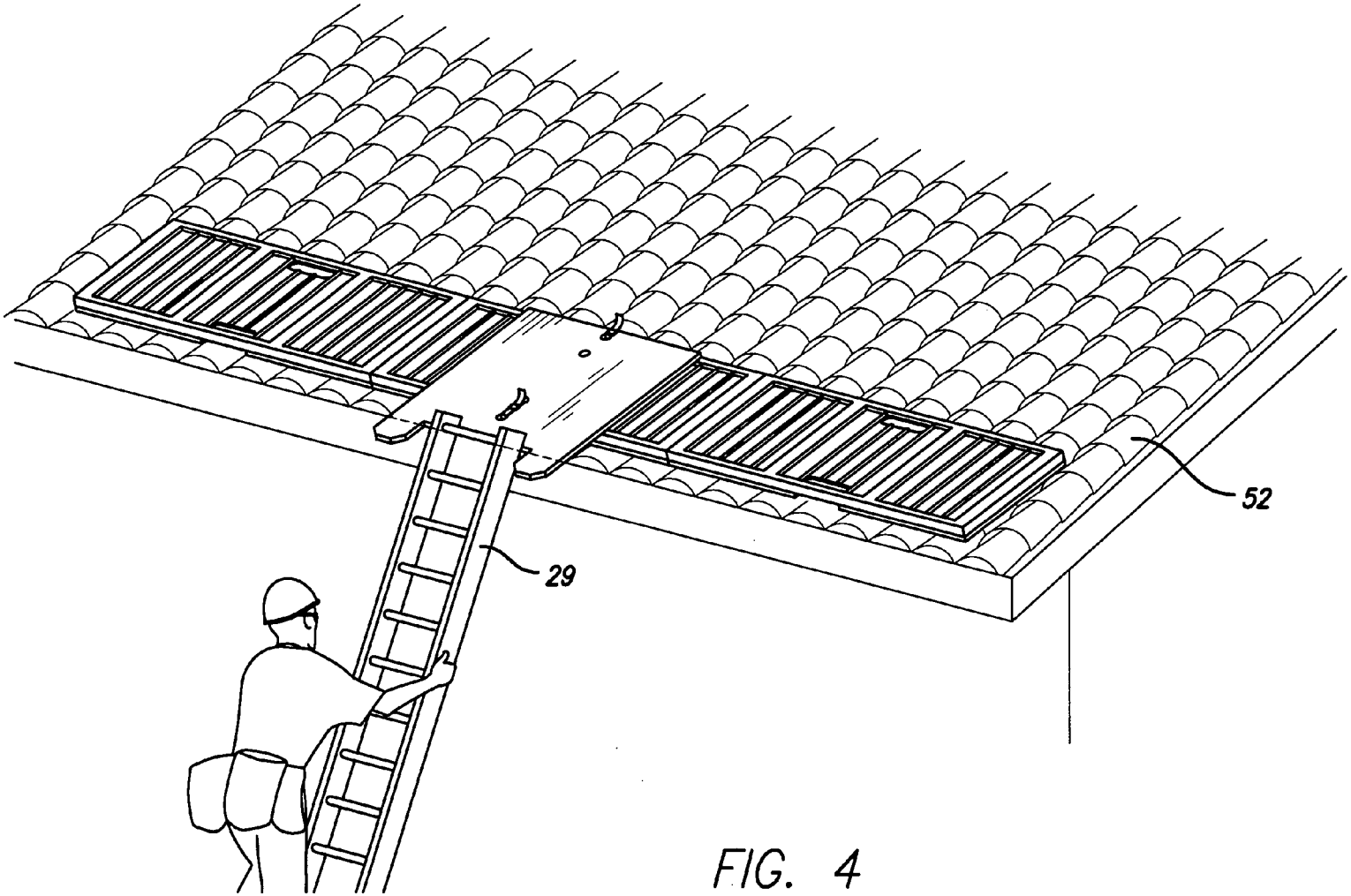
FIG. 4 is a perspective view of the panel member attached to the support platform disposed upon and a short distance from the edge of an underlying roof surface with a ladder shown being climbed by a construction worker contained from lateral movement in accordance with the present invention.
Figure 5:
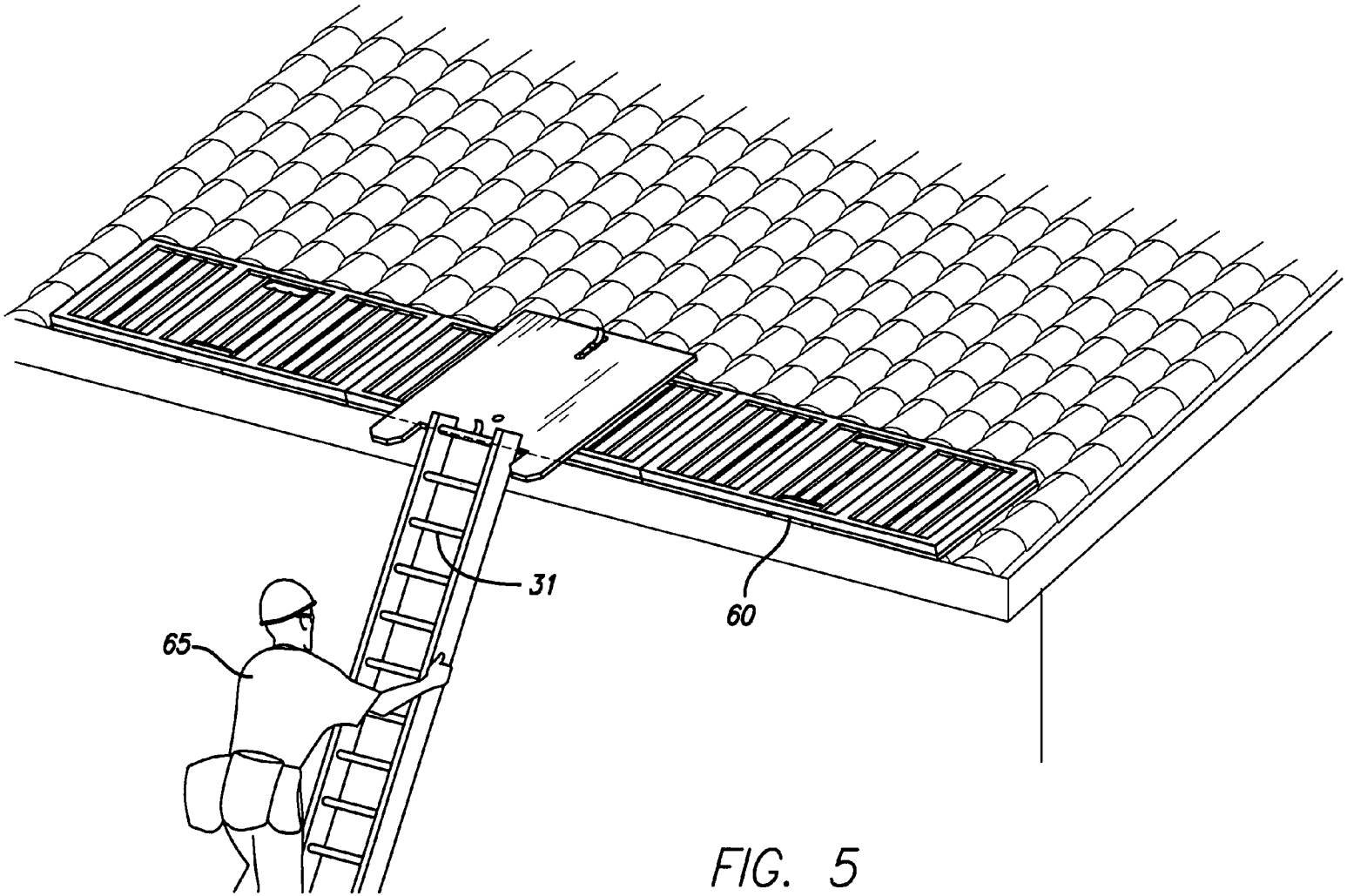
FIG. 5 is a perspective view of the panel member adjusted to extend incrementally rearward of the back edge of a support platform to ensure that the front U-shaped section is disposed closer to the edge of the underlying roof surface to better secure the ladder and prevent its lateral movement in accordance with the present invention.
Figure 6:
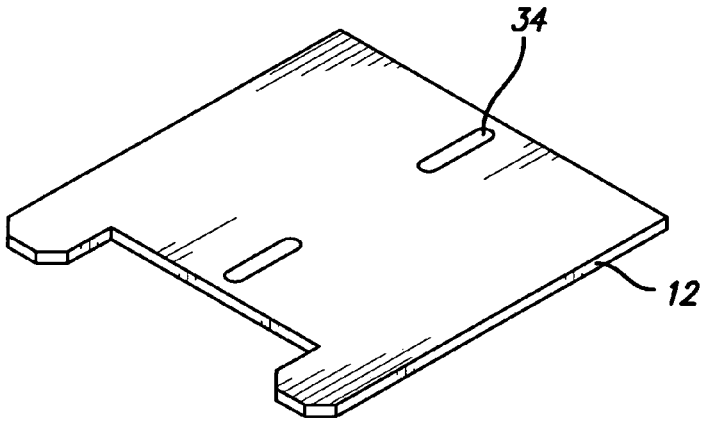
FIG. 6 is a perspective view of the panel member with slotted openings in accordance with the present invention.
Figure 7:
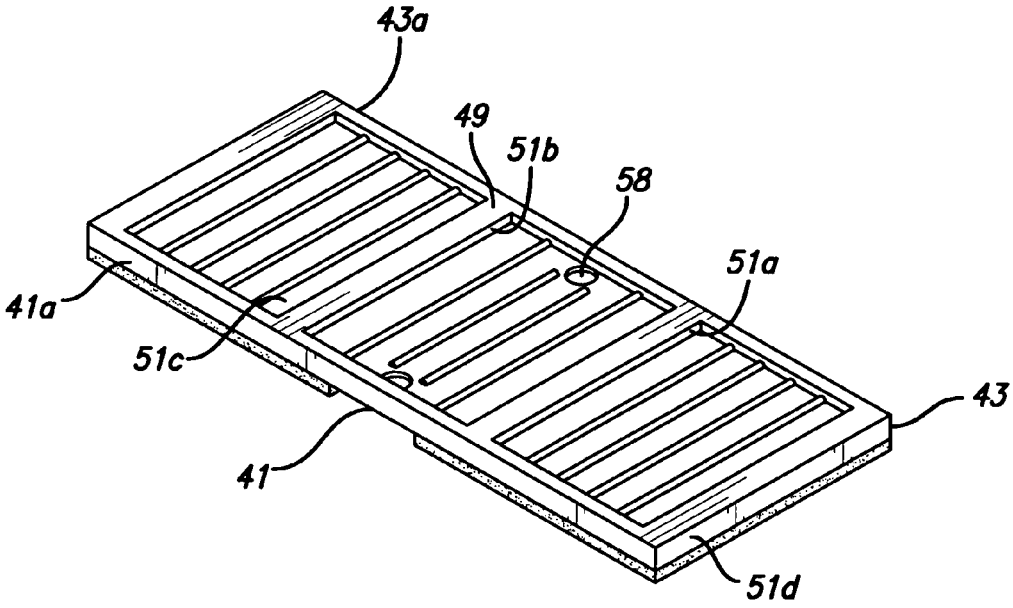
FIG. 7 is a perspective view of the support platform with rounded openings in accordance with the present invention.

FIG. 2 illustrates the preferred embodiment of the essential elements of the improved ladder safety device 10, specifically panel member 12 shown with support platform 40, in accordance with the present invention. Panel member 12 shown slightly enlarged in FIG. 1 comprises top side 14, bottom side 16, back edge portion 18, first side edge portion 20, second side edge portion 22, and front U-shaped edge portion 24 with laterally spaced apart forwardly extending arms 26 and 28 for containing there between ladder 29 and preventing its lateral movement beyond arms 26 and 28.

In one of several embodiments of the present invention, attached to bottom side 16 of panel member 12 are first L-shaped bracket 13, second L-shaped bracket 15, third L-shaped bracket 17, and fourth L-shaped bracket 19 for use in tightly securing panel member 12 and support platform 40 together.

In one alternative embodiment of the present invention (FIG. 11), all four such brackets (i.e. brackets 13,15,17 and 19) may be employed to connect and secure panel member 12 to support platform 40. In another embodiment of the present invention (FIG. 13), first L-shaped bracket 13 and second L-shaped bracket 15 may be sufficient for this purpose. In yet another embodiment of the present invention (FIG. 12), third L-shaped bracket 17 and fourth L-shaped bracket 19 are also suitable for the intended purpose (FIGS. 11 through 16).

Figure 15:
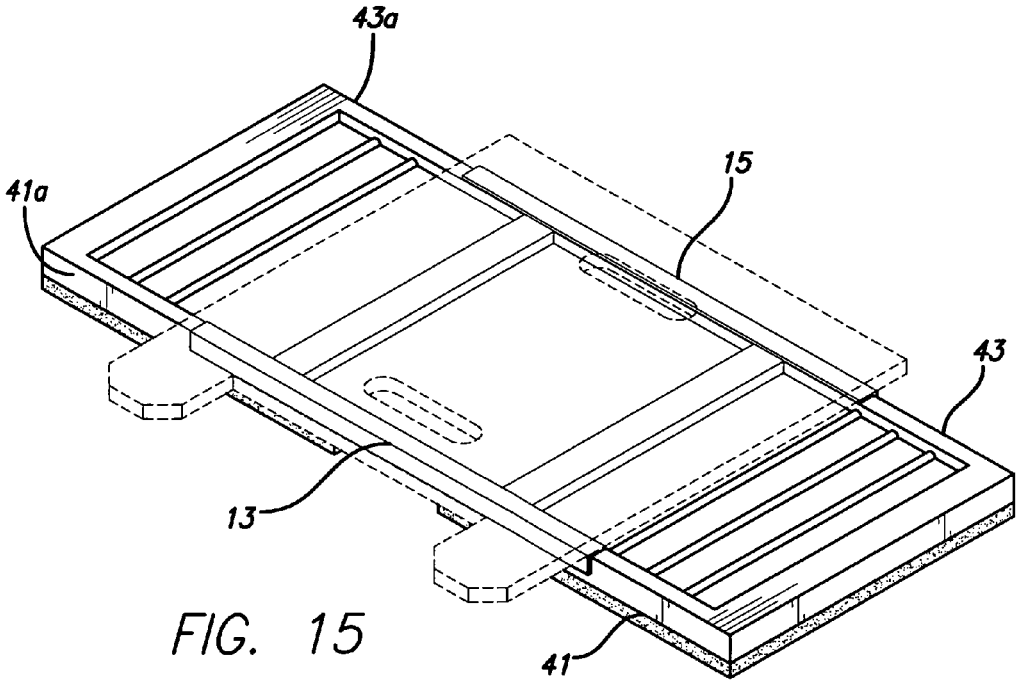
FIG. 15 is a perspective view of another alternative embodiment of the panel member and support platform attached in accordance with the present invention.

In all the aforementioned embodiments, the face opposed or interior surfaces of the vertical sections of the L-shaped brackets, e.g. inside surface 13*a* of vertical section 13*b* of L-shaped bracket 13 and inside section 15*a* of vertical section 15*b* of L-shaped bracket 15, are separated by a distance that is slightly less than the distance between, for example, outside vertical surface 41*a* of forward edge 41 and outside vertical surface 43*a* of rearward edge 43 (FIG. 15). Accordingly, L-shaped brackets 13 and 15, when disposed in a manner overlapping outside vertical surfaces 41 a and 43*a*, respectively, and set firmly into place upon support platform 40, are ensured a tight and secure fit.

Figure 14:
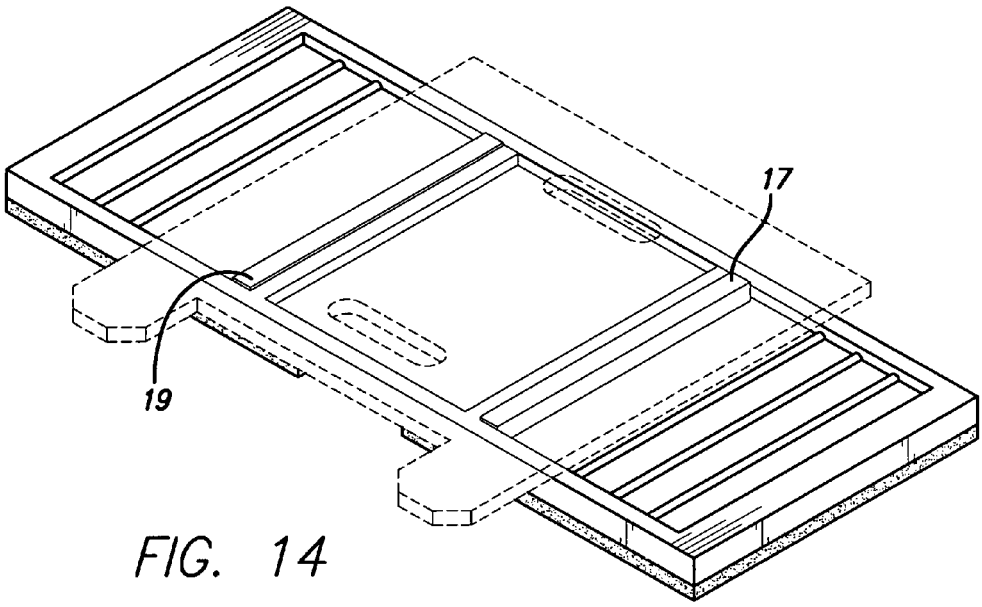
FIG. 14 is a perspective view of an alternative embodiment of the panel member and support platform attached in accordance with the present invention.

Similarly, the same relative dimensions exist with respect to inside surface 17*a* of vertical section 17*b* of L-shaped bracket 17 and inside surface 19*a* of vertical section 19*b* of L-shaped bracket 19 when L-shaped brackets 17 and 19 are disposed and set firmly into place upon any two generally elongated rectangular ribs 49 in a manner overlapping adjacent corresponding vertical sidewalls, such as, for example, any appropriate two sidewalls 51*a*, 51*b*, 51*c*, or 51*d* (FIG. 14).

Figure 16:
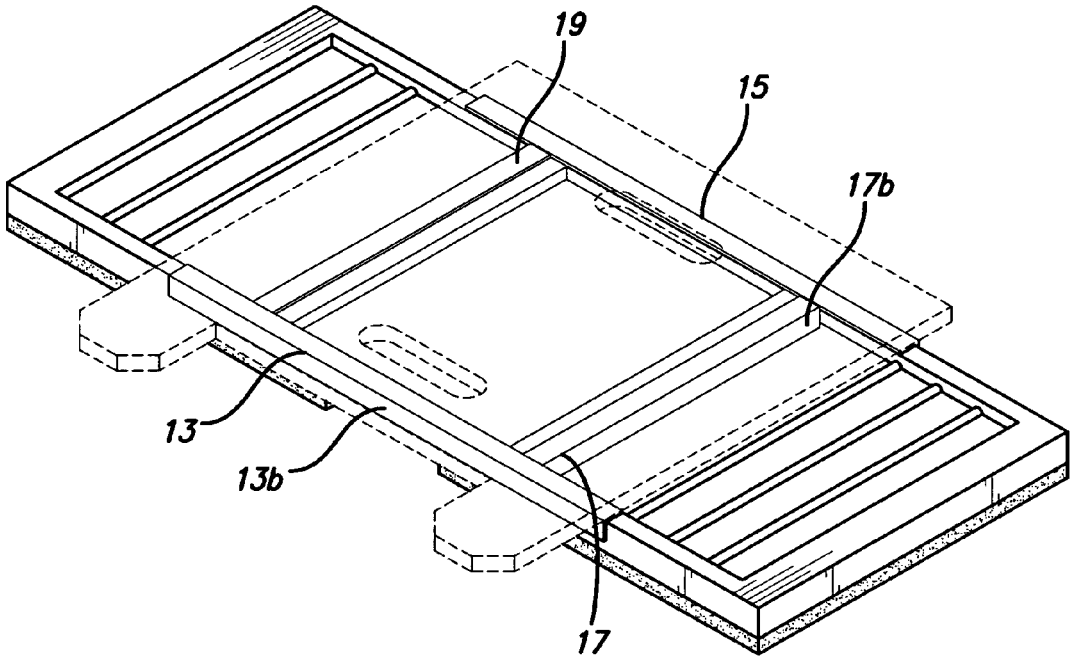
FIG. 16 is a perspective view of another alternative embodiment of the panel member and support platform attached in accordance with the present invention.
Figure 17:
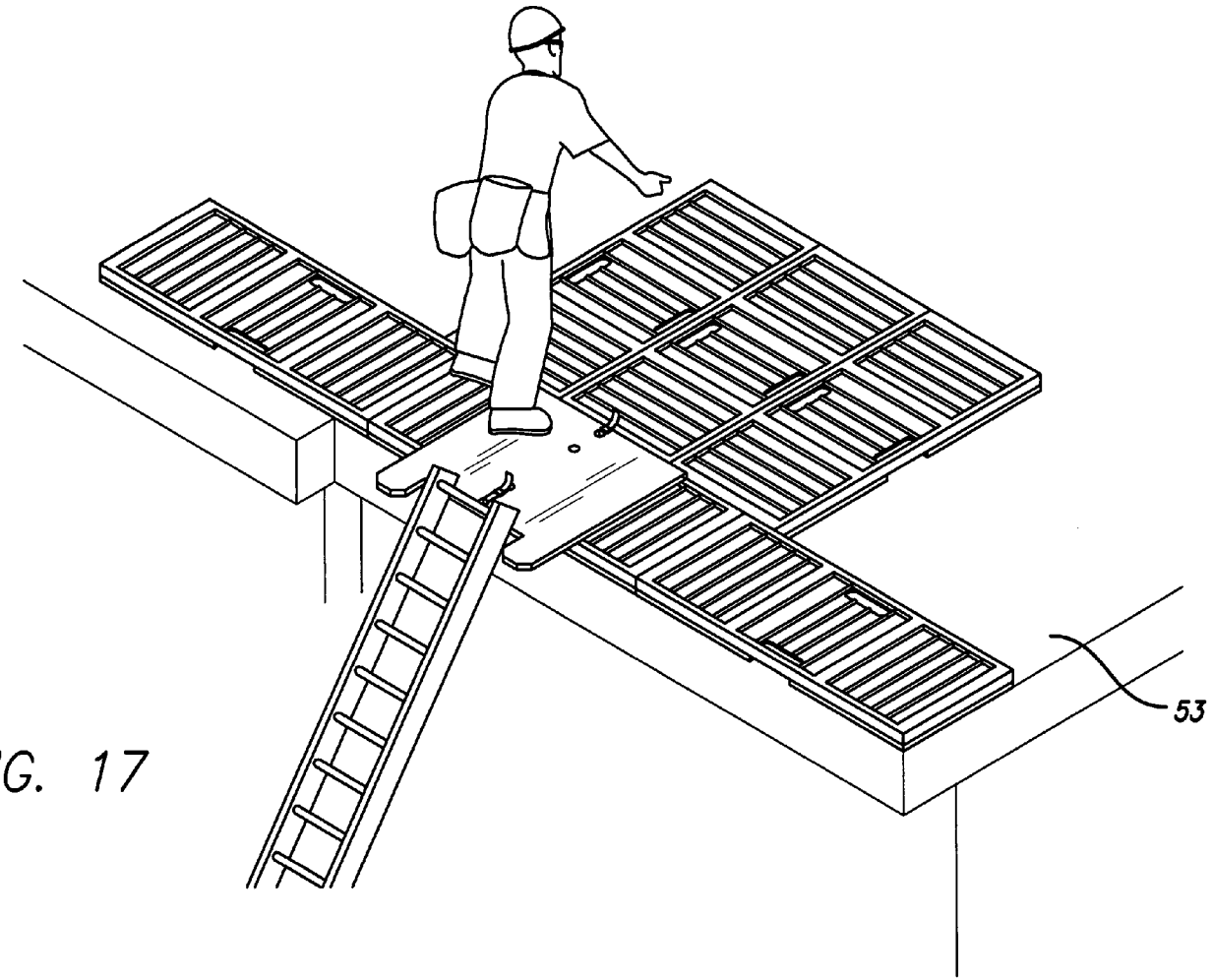
FIG. 17 is a perspective view of the panel member and support platform attached and disposed upon an elevated flat roof in accordance with the present invention.

Another application of the same relative dimensional relationship that ensures that panel member 12 and support platform 40 bond properly and securely is the employment of all four L-shaped brackets (i.e. 13,15,17 and 19) in a similar overlapping manner to fix the connection to further ensure against movement of panel member 12 with respect to support platform 40 in any direction (FIG. 16).

Panel member 12 may be formed in the shape of a rectangle, square or any other suitable configuration and may be comprised of a variety of materials, including, but not limited to, natural or synthetic, such as wood, metal alloy or resilient thermoplastic resin. Dimensions may vary depending on several factors, including the requirements of the worker and demands of the work site, though 3 to 4 feet square or 2 to 3 feet in width by 2 to 4 feet in length are typical. Panel member 12 is normally about one-half to one inch thick and includes a minimum of one opening, though two or more openings 30 are preferred and ensure the maximum effectiveness and adjustability when securing panel member 12 to support platform 40. Openings 30 are usually rounded 32 or slotted 34 though other configurations may be suitable.

Support platform 40 includes upper section 42 with surface 44 formed with a plurality of generally spaced apart horizontally disposed ribs 46, including generally triangular shaped ribs 47 and generally elongated rectangular shaped ribs 49, to provide the worker's feet 48 better and more stable footing while walking upon support platform 40 and transitioning from one platform 40 to another platform. Upper section 42 is normally comprised of a resilient synthetic material easy to mold, such as polyethylene, or a light metal alloy. Wood and other materials not mentioned here may also be suitable. A first end section 45, a second end section 47, a forward edge 41 and a rearward edge 43 are also included. Bottom section 50, which is attached to upper section 42 in any conventional manner, such as a strong adhesive, is made from a material with gripping capabilities to ensure maximum frictional engagement with roof surface 52. Such materials include, but are not limited to, deformable substances, such as foam or rubber. The dimensions of support platform 40 may vary, but typically are generally 2 to 3 feet in width, 2 to 4 feet in length, and 3 to 6 inches thick. Support platform 40 also includes one or more openings, including generally slotted openings 56 or even rounded openings 58. Openings with other configurations may also be suitable.

In one preferred application, one or more support platforms 40 are disposed adjacently attached upon an underlying sloped roof surface 52 or elevated flat roof surface 53, usually generally parallel to edge 60 of roof surface 52, either relatively close to edge 60 or some distance away depending upon the requirements of the construction project and the worker 65. Despite the location of the actual work site upon roof surface 52 or surface 53, for the present invention to function at maximum effectiveness, one or more support platforms 40 must be situated at or near edge 60 to provide safe and reliable access to ladder rungs 31 located at the top of ladder 29 and, more importantly, panel member 12 must be positioned to properly and securely stabilize the upstanding ladder. In appropriate situations, panel member 12 may be attached directly to roof surface 52.

Figure 8A:
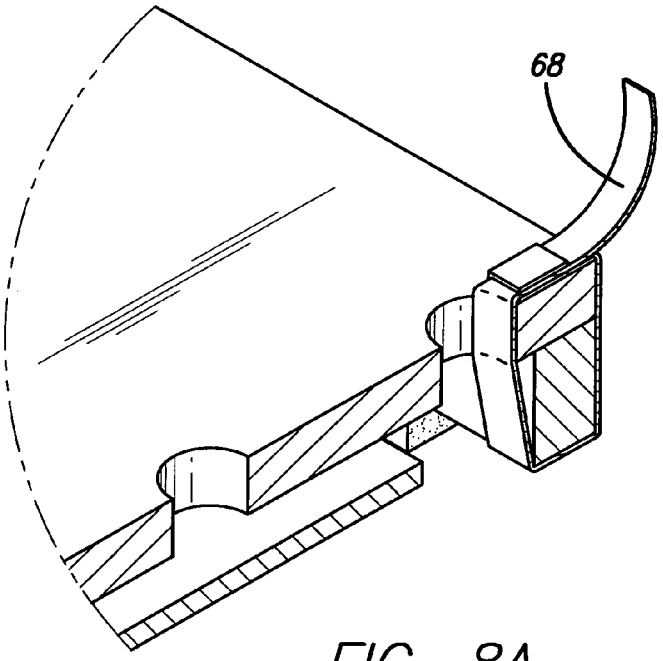
FIGS. 8*a* and 8*b* are enlarged perspective views of connected panel members and support platforms depicting alternative means of attachment in accordance with the present invention.
Figure 8B:
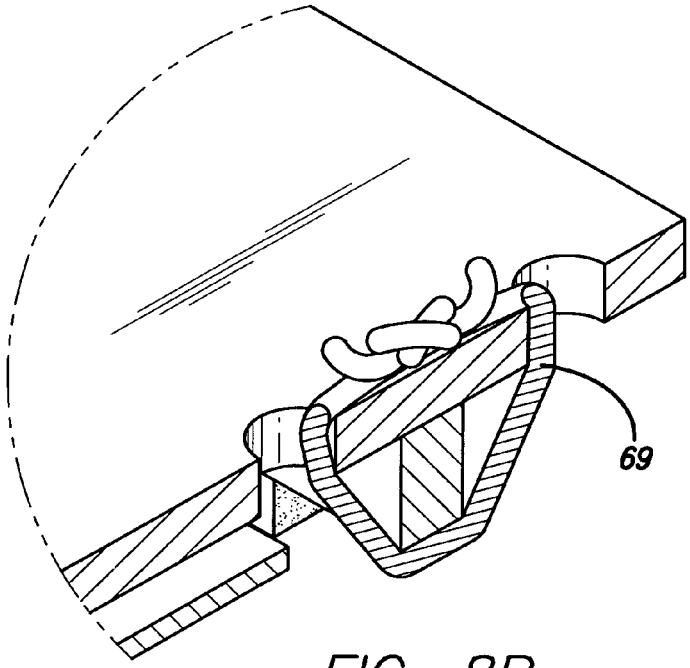

In one preferred application, panel member 12 and support platform 40 are aligned in a normal or perpendicular relationship to enable the two components to be securely attached with panel member 12 acting to contain and stabilize ladder 29 between spaced apart forwardly extending arms 26 and 28 and support platform 40 serving to anchor the two elements and frictionally engage, for example, sloped roof surface 52 to prevent slippage and minimize, if not altogether prevent, any risk of injury that might result from the destabilization of ladder 29. Employed, as needed, to attach panel member 12 to support platform 40 utilizing any of the embodiments described or shown in the drawings herein are a variety of connector means, including, but not limited to, straps 68 and rope 69 (FIGS. 8*a* and 8*b*) and a wide variety of other suitable connection means not otherwise mentioned here.

Figure 9:
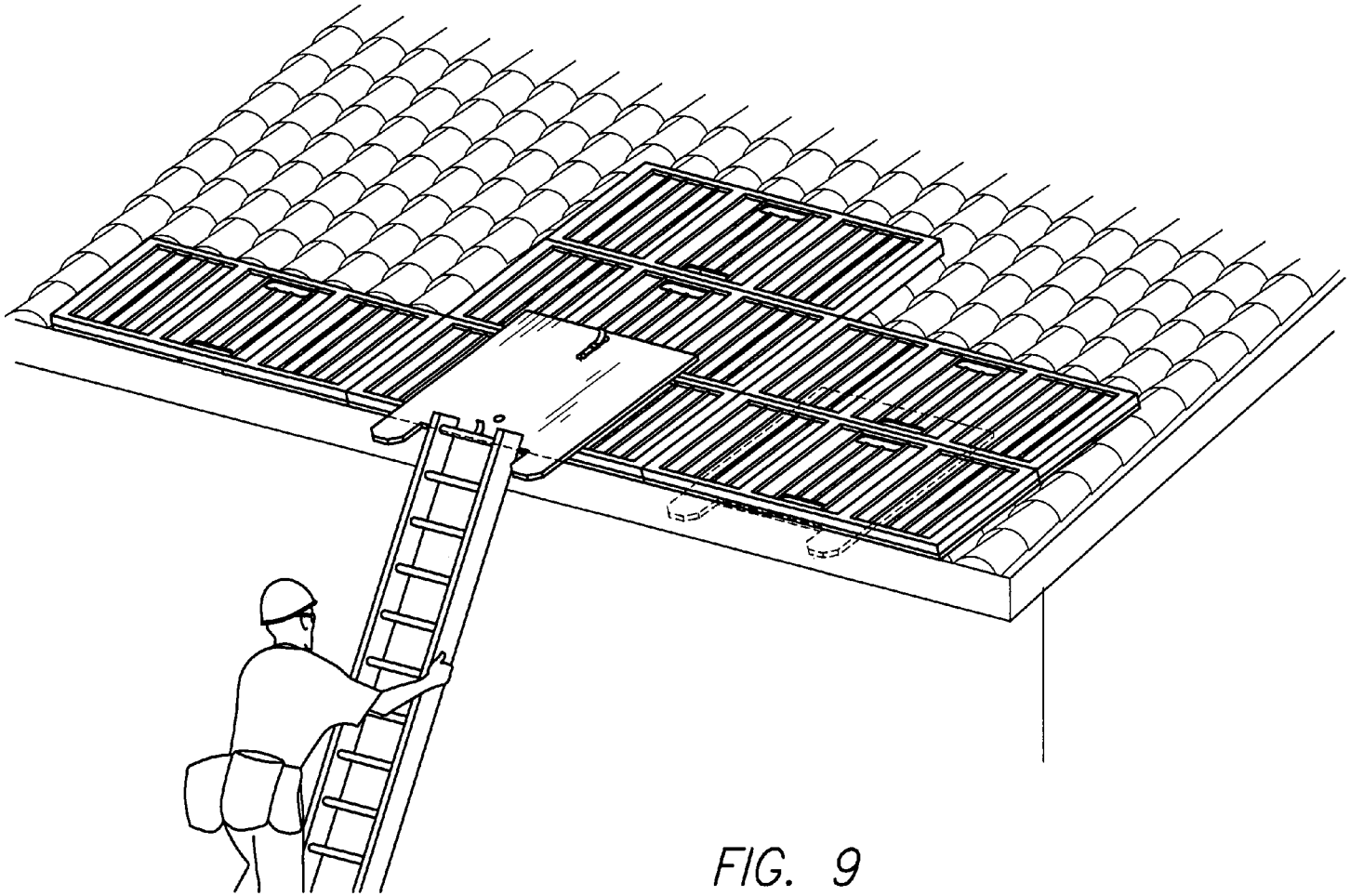
FIG. 9 is a perspective view of the panel member shown relative to several support platforms disposed upon a sloped underlying roof surface depicted first attached to one support platform and then, after adjustment, depicted in phantom view attached to the platform immediately to the right to enable the ladder to remain safely and properly positioned in accordance with the present invention.
Figure 10:
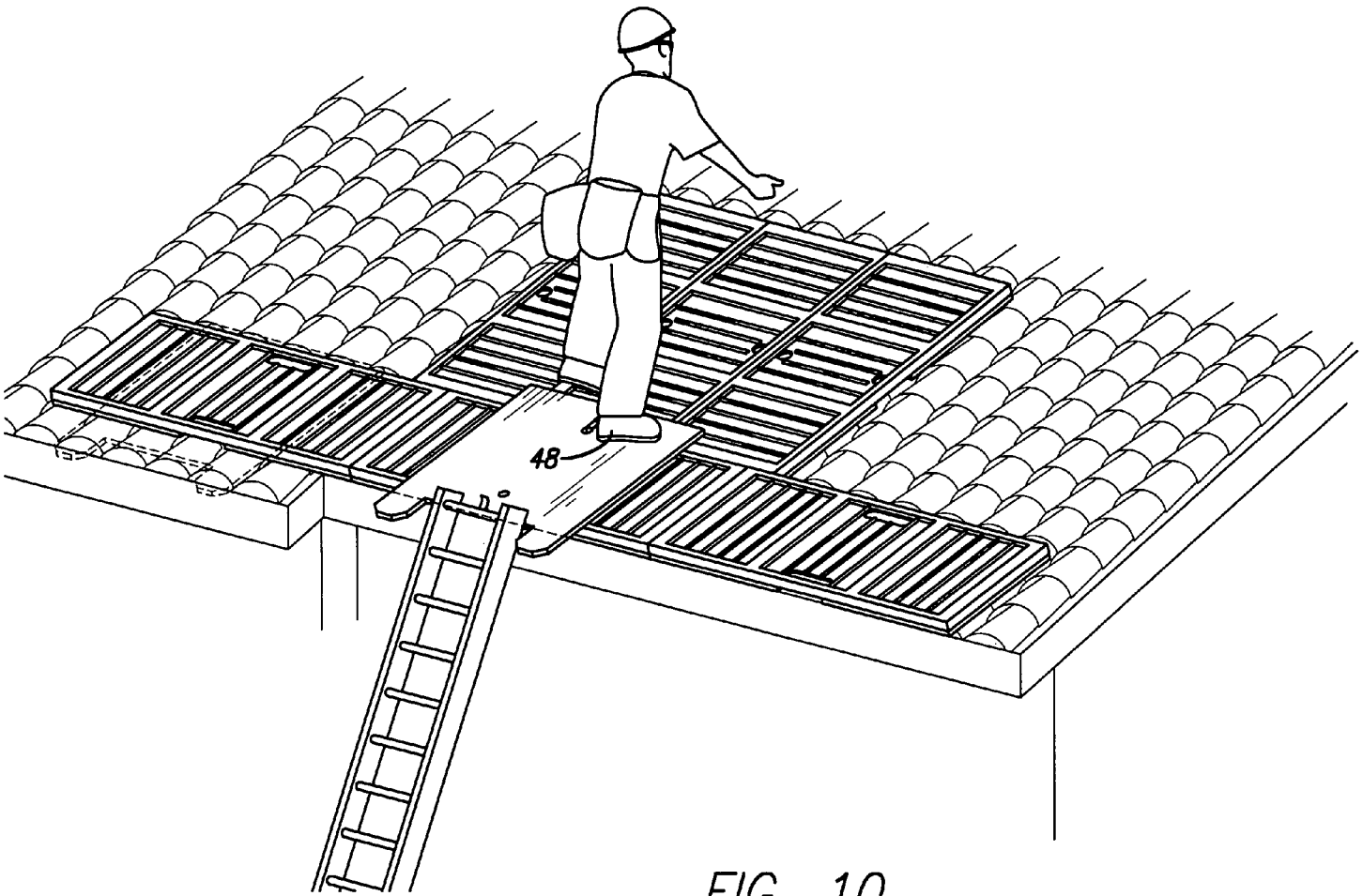
FIG. 10 is another perspective view of the panel member shown in two positions, one in phantom view, relative to several support platforms disposed on a slope underlying roof surface in the process of adjusting its position relative to a plurality of adjacently placed support platforms alongside or near the edge of a roof with a slight jog in the roof structure to better position and maintain stabilization for the ladder in accordance with the present invention.
Figure 11:
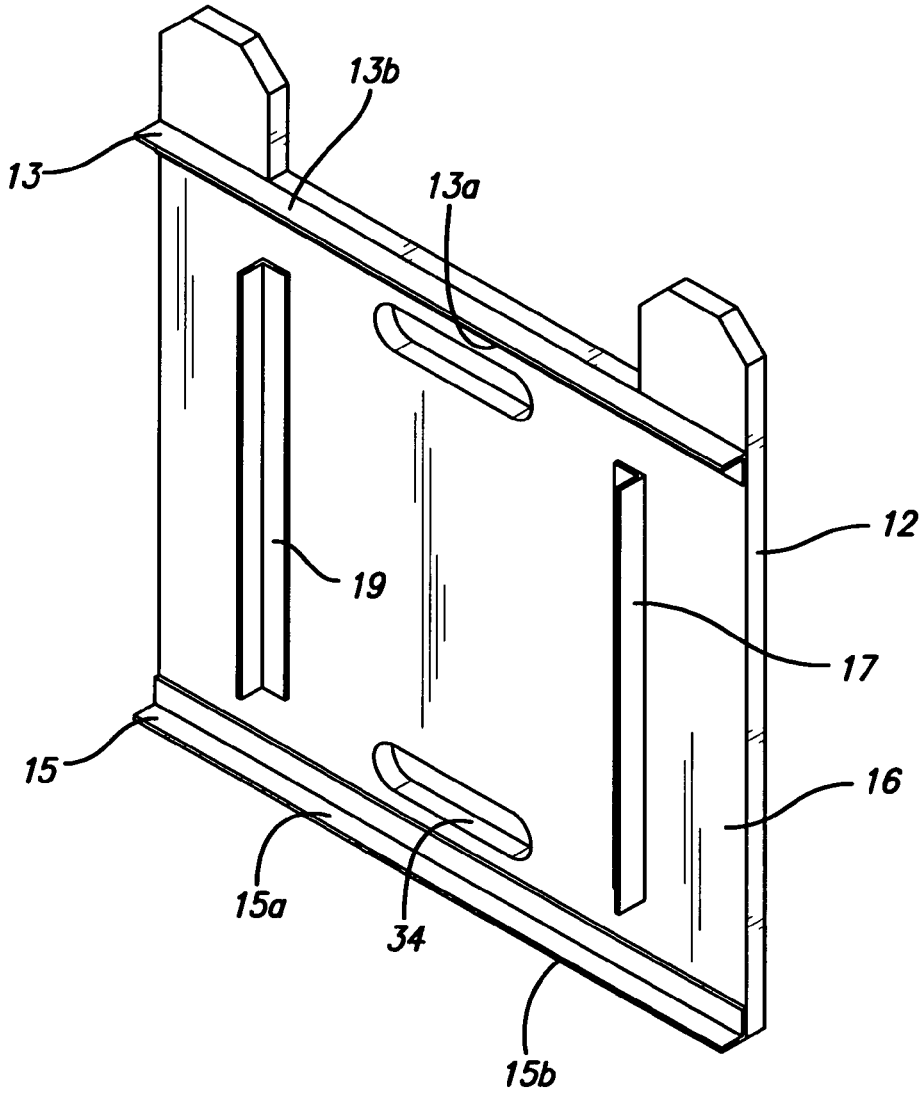
FIG. 11 is a bottom perspective view of an alternative embodiment of the panel member in accordance with the present invention.
Figure 12:
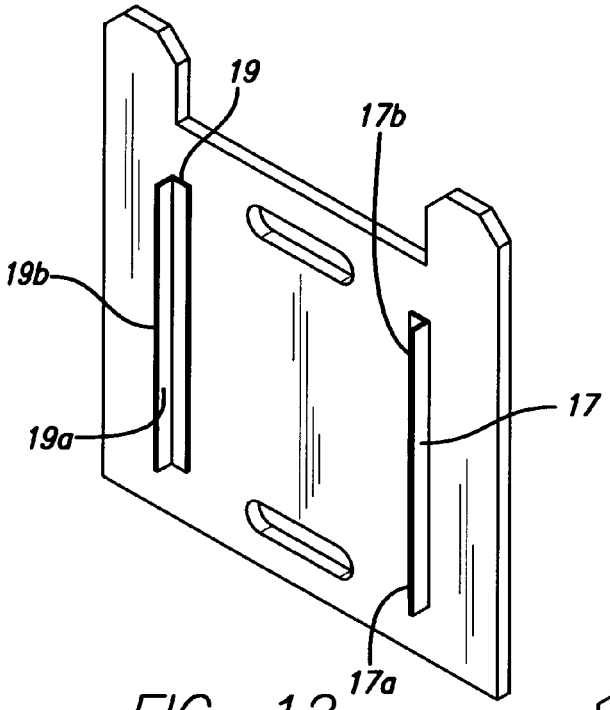
FIG. 12 is a bottom perspective view of another alternative embodiment of the panel member in accordance with the present invention.
Figure 13:
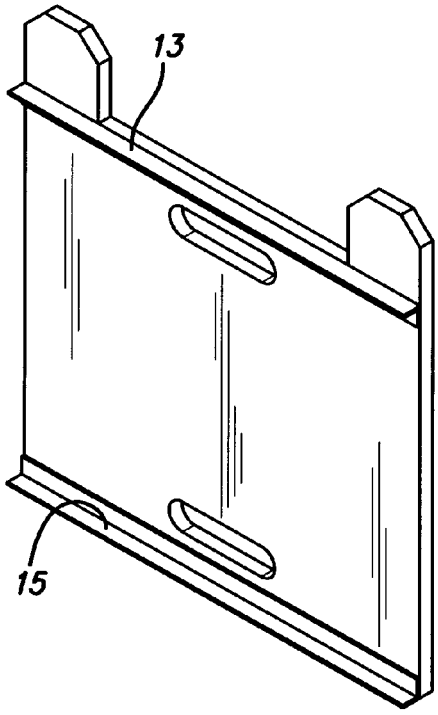
FIG. 13 is a bottom perspective view of another alternative embodiment of the panel member in accordance with the present invention.

In a related application, panel member 12 may be easily disconnected from support platform 40 (see FIG. 9) and positioned across roof surface 52 to adjacently situated support platform 40 and then reconnected, as already described. Ladder 29 is again situated in place to give worker 65 access to roof surface 52 in a different location. Depending upon where support platform 40 is situated on roof surface 52 or how far from edge 60 it is placed, it may become necessary to extend panel member 12 forward or rearward relative to forward edge 41 or rearward edge 43 of support platform 40 to position front U-shaped edge portion 24 in the most effective location nearest to roof edge 60. This provides ladder 29 the maximum stability and containment and ensures the integrity of the relationship between ladder 29 and panel member 12 and the safest working conditions for worker 65 (FIG. 10).

This invention has been described in its presently preferred embodiment, and it is clear that it is susceptible to numerous modifications, modes and embodiments within the ability of those skilled in the art and without the exercise of this inventive faculty.

The invention claimed is:

1. A safety device for a ladder comprising:

a panel member, said panel member having a top side, a bottom side, a back edge portion, a first side edge portion, a second side edge portion, and a front U-shaped edge portion with laterally spaced-apart outwardly extending arms for positioning there between said ladder for containing said ladder and preventing said ladder's lateral movement beyond said arms;

one or more said support platforms disposed upon an underlying roof surface having a roof edge, each of said support platforms having a top section with a first end section, a second end section, a first side edge and a second side edge and a bottom section adapted in frictional engagement with said underlying roof surface, said top section having a surface formed with a plurality of horizontally disposed ribs to provide and ensure stable footing;

said panel member and said support platform each having means adapted for releasable engagement to enable said panel member to easily connect to and disconnect from said support platform to adjust the positioning of said panel member relative to one or more of said support platforms situated along or near the edge of said roof surface.

2. The safety device of Claim 1 wherein said horizontally displaced ribs comprise a plurality of elongated generally triangular cross members and two or more generally elongated rectangular cross-members disposed in parallel relation across said surface of said top section.

3. The safety device of Claim 2 wherein each said generally rectangular cross-member has a top surface, a first vertical side and a second vertical side.

4. The safety device of Claim 3 wherein said means adapted for releasable engagement to enable said panel member to easily connect to said support platform and disconnect from said support platform to adjust the position of said panel member relative to one or more of said support platforms situated along or near the edge of said roof surface comprises a first L-shaped bracket attached to said bottom side adjacent said front U-shaped edge portion of said panel member, a second L-shaped bracket attached to said bottom side adjacent said back edge portion of said panel member, said first L-shaped bracket and said second L-shaped bracket adapted to secure conformably in a tightly fitting overlap relation to said first side edge and said second side edge, respectively, of said support panel.

5. The safety device of Claim 4 wherein said means adapted for releasable engagement to enable said panel member to easily connect to said support platform and disconnect from said support platform to adjust the position of said panel member relative to one or more of said support platforms situated along or near the edge of said roof surface comprises a third L-shaped bracket attached to said bottom side of said panel member and a fourth L-shaped bracket attached to said bottom side of said panel in spaced-apart parallel relation, said third L-shaped bracket and said fourth L-shaped bracket adapted to secure conformably in a tightly fitting overlap relation to said corresponding aligned said first vertical side and said second vertical side of any two spaced-apart generally rectangular cross-members.

6. The safety device of Claim 4 wherein said means adapted for releasable engagement to enable said panel member to easily connect to said support platform and disconnect from said support platform to adjust the position of said panel member relative to one or more of said support platforms situated along or near the edge of said roof surface comprises a first L-shaped bracket attached to said bottom side adjacent said front U-shaped edge portion of said panel member, a second L-shaped bracket attached to said bottom side adjacent said back edge portion of said panel member, said first L-shaped bracket and said second L-shaped bracket adapted to secure conformably in tightly fitting overlap relation to said first side edge and said second side edge, respectively, of said support panel, and further comprising a third L-shaped bracket attached to said bottom side of said panel member and a fourth L-shaped bracket attached to said bottom side of said panel member in spaced-apart parallel relation, said third and fourth L-shaped brackets adapted to secure conformably in tightly fitting overlap relation to said corresponding aligned first or second vertical sides of at least two said spaced-apart generally rectangular cross-members.

7. The safety device of Claim 1 wherein said underlying roof surface is sloped.

8. The safety device of Claim 1 wherein said means adapted for releasable engagement to enable said panel member to easily connect to said support platform and disconnect from said support platform to adjust the position of said panel member relative to one or more of said support platforms situated along or near the edge of said roof surface comprises one or more openings.

9. The safety device of Claim 8 wherein each of said openings is slotted.

10. The safety device of Claim 1 wherein said means adapted for releasable engagement to enable said panel member to easily connect to said support platform and disconnect from said support platform to adjust the position of said panel member relative to one or more of said support platforms situated along or near the edge of said roof surface comprises a material from the group that includes rope and strap made from natural or synthetic materials and wire made from metal or polyethylene fibers.

11. The safety device of Claim 1 wherein said bottom portion of said support platform is comprised of deformable foam.

12. The safety device of Claim 1 wherein said top portion of said support platform is comprised of a resilient synthetic material.

13. The safety device of Claim 1 wherein said panel member is comprised of natural wood.

14. The safety device of Claim 1 wherein said panel member is comprised of a resilient synthetic material.

15. The safety device of Claim 1 wherein said panel member is comprised of a metal alloy.

16. The safety device of Claim 1 wherein said panel member and said support platform are adapted to be attached and adjustable relative to one another to enable said panel member to extend incrementally forward or incrementally rearward of either said first side edge portion of said support platform or said second side edge portion of said support platform to enable adjustable positioning relative to said ladder and said roof edge.

17. The safety device of Claim 1 wherein said underlying roof surface is flat.

* * * * *